US006897843B2

(12) United States Patent
Ayres et al.

(10) Patent No.: US 6,897,843 B2
(45) Date of Patent: May 24, 2005

(54) ACTIVE MATRIX DISPLAY DEVICES

(75) Inventors: John R. A. Ayres, Reigate (GB); Martin J. Edwards, Crawley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 192 days.

(21) Appl. No.: 10/191,292

(22) Filed: Jul. 9, 2002

(65) Prior Publication Data

US 2003/0016201 A1 Jan. 23, 2003

(30) Foreign Application Priority Data

Jul. 14, 2001 (GB) ..... 0117226
Oct. 30, 2001 (GB) ..... 0125969

(51) Int. Cl.[7] ..... G09G 3/36
(52) U.S. Cl. ..... 345/90; 345/89; 345/92
(58) Field of Search ..... 345/55, 76, 82, 345/87, 89, 90, 92, 98, 204

(56) References Cited

U.S. PATENT DOCUMENTS 4,430,648 A 2/1984 Togashi et al. ..... 340/718
4,471,347 A 9/1984 Nakazawa et al. ..... 340/719
5,130,829 A 7/1992 Shannon ..... 359/59
5,448,258 A 9/1995 Edwards ..... 345/90
5,923,311 A 7/1999 Edwards ..... 345/92
6,169,532 B1 1/2001 Sumi et al. ..... 345/98
6,246,386 B1 * 6/2001 Perner ..... 345/90

FOREIGN PATENT DOCUMENTS

EP 0378249 A 9/1983 ..... G09G/3/20
EP 0797182 A1 9/1997 ..... G09G/3/36
WO WO0101384 1/2001 ..... G09G/3/32

* cited by examiner

*Primary Examiner*—Regina Liang

(57) ABSTRACT

An active matrix display device includes a plurality of pixels (10) arranged as rows and columns and column electrodes (16) extending along corresponding columns of pixels (10). The pixels include a capacitance (18,70) for storing image data and a read circuit for reading the charge stored on the capacitance (18,70) and driving the column electrode with the read charge.

16 Claims, 7 Drawing Sheets

ACTIVE MATRIX DISPLAY DEVICES

The present invention relates to active matrix display devices comprising arrays of display pixels, and particularly, although not exclusively, to active matrix liquid crystal display devices and active matrix electroluminescent display devices.

Active matrix display devices, and more notably active matrix liquid crystal display devices (AMLCDs), are now used in an increasing variety of product areas, amongst which laptop and notebook computer screens, desk top computer monitors, PDAs, electronic organisers and mobile phones are perhaps the most familiar.

The structure and general operation of a typical active matrix display device, in this case an AMLCD, are described in, for example, U.S. Pat. No. 5,130,829 whose whole contents are incorporated herein by way of reference material. Briefly, such a display device comprises an array of pixels, arranged in rows and columns, each comprising an electro-optic display element and an associated switching device, usually in the form of thin film transistor (TFT). The pixels are connected to sets of row and column address electrodes, each pixel being located adjacent the intersection between a respective electrode of each set, via which the pixels are addressed with selection (scanning) signals being applied to each of the row electrodes in sequence to select that row and with data (video information) signals being supplied in synchronism with row selection via the column address electrodes to the pixels of the selected row and determining the display outputs of the individual pixels of the row concerned. The data signals are derived by appropriately sampling an input video signal in a column address circuit coupled to the column address electrodes. Each row of pixels is addressed in turn so as to build up a display from the whole array in one field (frame) period, with the array of pixels being repeatedly addressed in this manner in successive fields. There is a need to refresh the pixels regularly with video information due to losses which occur in the pixels. In the case of an AMLCD, the polarity of the data signal voltage applied to the display elements needs to be inverted periodically in order to prevent degradation of the LC material. This may be done for example after each field (so-called field inversion) or after each row has been addressed as well (so-called line or row inversion).

A significant fraction of the power consumption of an active matrix display device is associated with transferring video information from the video signal source to the pixels of the display device. This component of the power can be reduced if the pixels of the display device are able to store the video information for an indefinite period of time. In this case the addressing of the pixels with fresh video information can be suspended when no change to the display output (brightness) state of pixels is required.

Incorporating memory into the pixels of an active matrix display device can thus reduce power when a static image display is permitted because data need only be sent to the display pixels when the image changes and less power is, therefore, consumed in external circuits and in driving the capacitance associated with connections to the display pixels.

One approach is to incorporate static memory cells in the pixels and to use the state of the memory to control the connection of the pixel electrode to an appropriate drive source. However, a major disadvantage with static memory is the complexity in terms of the number of transistors and bus lines required for power and control signals.

Another known approach for AMLCD displays is to use the pixel (with one TFT/pixel) as a dynamic 1 bit/pixel memory. Sensing the state of the pixel is achieved by adding a sense amplifier to the column electrodes which can detect small voltage changes when the pixel is connected to the column electrode. The pixel can then be refreshed, as required by the dynamic nature of the memory. A problem with this approach is that the size of the signal to be sensed on the column electrodes is determined by the ratio of pixel to column capacitance, which can be very small in an AMLCD with predetermined pixel pitch and resolution. Another problem is that as it is customary to drive the LC material used in an AMLCD with voltages of alternating polarity to limit degradation of the material a sophisticated external sense and refresh circuit to drive the columns is required.

An example of an AMLCD of this kind is described in U.S. Pat. No. 4,430,648, whose whole contents are incorporated herein by way of reference material. In this, the periodic refreshing of the voltages on the pixels in order to maintain an image on the display is achieved by incorporating sense and refresh circuitry within the column addressing circuit of the display. During the refresh operation charge is transferred from the pixels in one row of the display device onto the corresponding, associated, column electrodes. Then the sense circuitry is used to detect this charge and determine the state of the pixels. This information is then written back to the same pixels by the refresh circuitry. Because of the relatively large value of the column capacitance in comparison to the pixel capacitance the signals which must be detected by the sense circuits are relatively small and this makes the design of the sense circuits difficult and their performance critical to the operation of the display device. In particular the display device may be sensitive to sources of electrical noise. In addition, as the pixels within the display device are refreshed the columns of the display device are driven in accordance with the stored video information by the refresh circuits. The charging and discharging of the column capacitance will contribute to the power consumption of the display device.

U.S. Pat. No. 6,169,532, whose whole contents are also incorporated herein by way of reference material, describes examples of both AMLCDs and active matrix electroluminescent display devices similarly using dynamic memory pixels in conjunction with sense amplifiers coupled to the column electrodes.

It is also known that display devices with some memory in the pixel circuits can also be operated in normal mode, without using the memory in pixel function. The integrated memory (which may be limited to just 1 bit/colour due to layout restrictions) is then used in a low power mode for displaying static images.

EP-A-0797182, whose whole contents are incorporated herein by way of reference material, describes various examples of dynamic memory circuits with in-pixel low impedance driver circuits used in AMLCDs.

Problems exist, however, with incorporating dynamic memory in the pixels. The integration of a reliable dynamic memory into the pixel of an active matrix display device, so as, for example, to avoid undue complexity or adversely affect the pixel aperture by restricting the number of components, such as transistors, required, is considered to be an important issue. Moreover, refresh of the dynamic storage element in the pixel needs also to be considered together with the appropriate drive voltages (or in-pixel drive circuits as the case may be) required for a particular type of display device.

The present invention provides active matrix display devices, that offer or permit improvements over the known devices. Various novel concepts, is inventive concepts and specific embodiments are disclosed herein, particularly but not exclusively with reference to the accompanying drawings.

An active matrix display device in accordance with a first aspect of the invention comprises: a plurality of pixels arranged as rows and columns; and column electrodes extending along the columns; wherein the pixels include an image data storage capacitance and a read circuit for reading the state of the image data storage capacitance and driving the corresponding column electrode in accordance with the read image data.

The read circuit accordingly functions as a buffer, so that the capacitance used as the dynamic storage element within a pixel can be refreshed via the column electrode. In contrast, in prior art arrangements without a read circuit integrated within the pixels but with a sense circuit at the end of each column line the small integrated capacitance within each pixel may be swamped by the capacitance of the column line making the effect of what may be a very small charge on the capacitance very hard to detect in the sense circuits. Moreover, by driving the column line with a read circuit the sensitivity of the active matrix display device to electrical noise may be reduced over prior art arrangements without such a circuit.

Indeed, in embodiments it may be possible to reduce the size of an image data storage capacitance or even replace a discrete capacitor with a capacitance present within the pixel for other reasons, such as the capacitance of a liquid crystal pixel electrode, by providing the read circuit.

Preferably, the read circuit has a high input impedance so that the capacitance is only insignificantly discharged during a read operation, say only 10% or less of the charge stored, preferably 2% or less.

Embodiments of the invention include row electrodes and read electrodes extending along the rows of pixels, the pixels containing a switch connecting the column electrode to the capacitance when the switch is selected by the row electrode and the read circuit being controlled by the read line to read the data stored on the capacitance onto the column electrode.

The pixels may contain a drive circuit driving a pixel display component, the drive circuit having its input connected to the image data storage capacitance. The drive circuit may drive an LED, a liquid crystal display electrode, or other pixel display component. The read circuit may in this case constitute a switch connecting the output of the drive circuit to the column electrode under the control of the read line.

Each pixel may include a plurality of image data storage capacitances.

In embodiments, the display may include a plurality of address lines along each row, each address line selecting a respective switch connecting a respective image data storage capacitance to a data line, and a select line controlling a switch connecting the data line to the column electrode, wherein the read circuit reads the data on the data line onto the column electrode under the control of a read line.

Alternatively, a dedicated read circuit may be connected to each image data storage capacitance.

The invention also relates to a method of operating an active matrix display device having pixel elements including storage nodes, comprising: storing image data on the storage nodes and operating the active matrix device in a static mode including: displaying the stored image data, and periodically applying read signals to read circuitry within the pixel elements to cause the read circuitry to read the stored image data to the column electrodes and refreshing the image data stored on the storage nodes.

The method may further include operating the active matrix display device in a normal mode including regularly addressing the pixel elements with fresh video information and displaying the video information.

Further features and advantages of the present invention will become apparent from reading of the following description of preferred embodiments, given by way of example only, and with reference to the accompanying drawings, in which.

The same reference numerals are used throughout the Figures to denote the same, or similar, parts.

Figure 1:
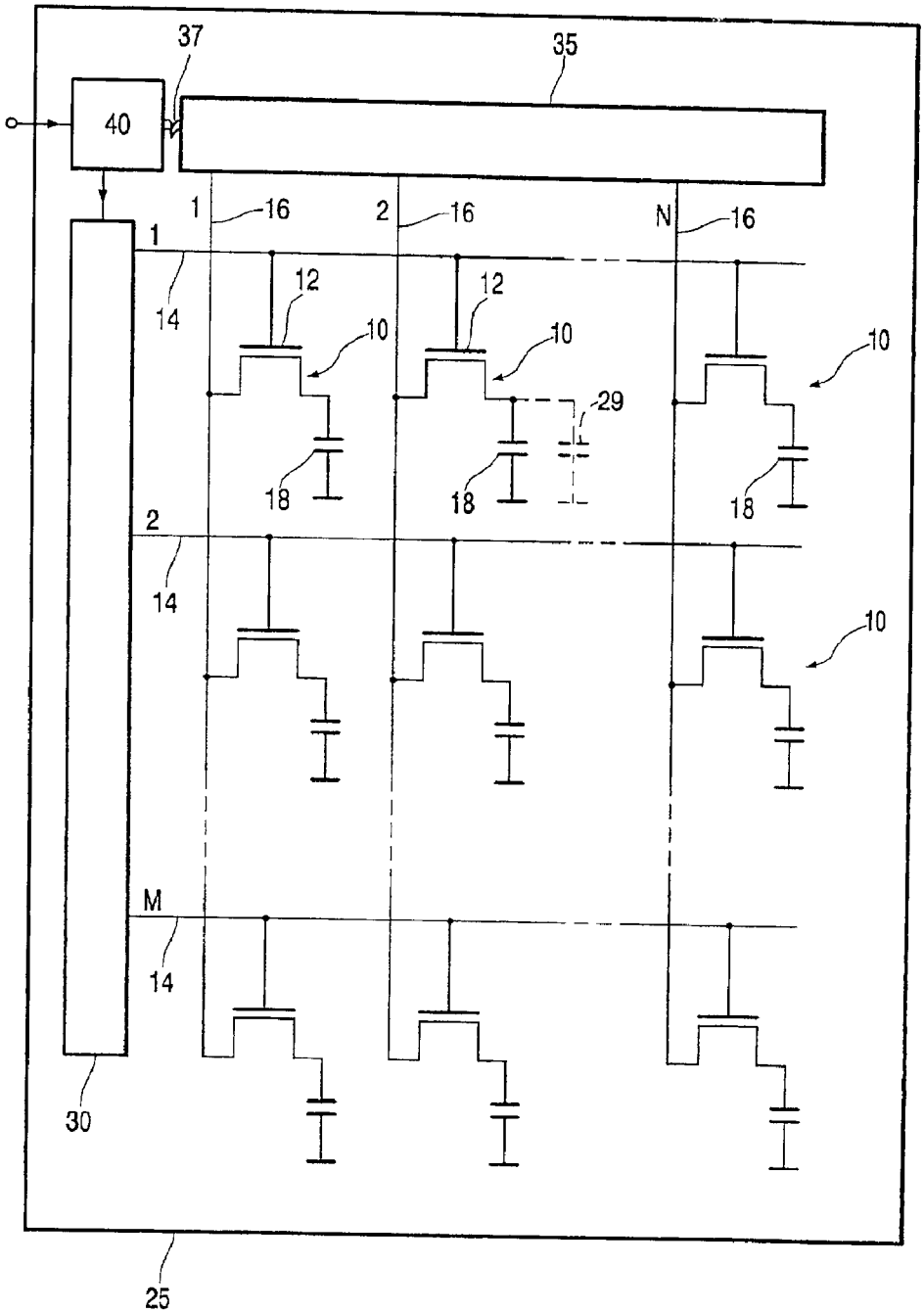
FIG. 1 is a simplified schematic diagram of a typical known AMLCD.

Referring to FIG. 1, a simplified schematic circuit diagram of a generally conventional form of AMLCD, comprising a row and column matrix array (NxM) of display pixels 10, is shown. The display pixels each have a liquid crystal display element 18 and an associated TFT 12 acting as a switching device, and are addressed via sets of (M) row and (N) column address electrodes 14 and 16. Only a few display pixels are shown here for simplicity and in practice there can be several hundred rows and columns of pixels. The drain of each TFT 12 is connected to a respective display element electrode situated adjacent the intersection of respective row and column address electrodes, while the gates of all the TFTs associated with a respective row of display pixels 10 are connected to the same row address electrode 14 and the sources of all the TFTs associated with a respective column of display pixels are connected to the same column address electrode 16. The electrodes 14, 16, the TFTs 12, and the display element electrodes are all carried on the same insulating substrate, for example of glass, and fabricated using known thin film technology involving the deposition and photolithographic patterning of various conductive, insulating and semiconductive layers. A second glass substrate, (not shown) carrying a continuous transparent electrode common to all display elements in the array is arranged spaced from the substrate 25 and the two substrates are sealed together around the periphery of the pixel array to define an enclosed space in which liquid crystal material is contained. Each display element electrode together with an overlying portion of the common electrode and the liquid crystal material therebetween defines a light-modulating LC display element.

In operation, selection (gating) signals are applied to each row address electrode 14 in turn, from row 1 to row M by a row driver circuit 30, comprising for example a digital shift register, and data signals are applied to the column electrodes 16, in synchronisation with the selection signals, by a column driver circuit 35. Upon each row electrode 14 being addressed with a selection signal, the pixel TFTs 12 connected to that row electrode are turned on causing the respective display elements to be charged according to the level of the data signal then existing on their associated column electrodes. After a row of pixels has been addressed in a respective row address period ($T_L$), corresponding, for example, to the line period of an applied video signal, their associated TFTs are turned off upon termination of the selection signal for the remainder of a field (frame) period in order to isolate electrically the display elements, thereby ensuring the applied charge is stored to maintain their display outputs until they are addressed again in a subsequent field period. Each of the rows of pixels in the array from row 1 to row M is addressed in turn in this way in respective successive row address periods $T_L$ so as to build up a display picture from the array in one field period Tf, where Tf is equal to, or slightly greater than $M \times T_L$, following which the operation is repeated for successive fields.

The timing of the operation of the row and column driver circuits 30 and 35 is controlled by a timing and control unit 40 in accordance with timing signals derived from an input video signal, obtained for example from a computer or other source. The video information signal in this input signal is supplied by a video signal processing circuit in the unit 40 to the column driver circuit 35 in serial form via a bus 37. This circuit comprises one or more shift register/sample and hold circuits which samples the video information signal in synchronism with row scanning to provide serial to parallel conversion appropriate to the row at a time addressing of the pixel array. Successive fields of video information according to successive fields of the input video signal are written into the array by repetitively addressing the pixel rows of the array in consecutive field periods.

For a transmissive mode of operation, the display element electrodes are formed of a light transparent conductive material such as ITO and the individual display elements serve to modulate light, for example directed onto one side from a backlight, so that a display image, built up by addressing all the pixel rows in the array, can be viewed from the other side. For a reflective mode of operation, the display element electrodes are formed of light reflecting conductive material and light entering the front of the device through the substrate carrying the common electrode is modulated by the LC material at each display element and reflected back through that substrate, depending on their display state, to generate a display image visible to a viewer at the front.

Following known practice, the polarity of the drive voltages applied to the display elements is periodically inverted, for example after every field, to avoid degradation of the LC material. Polarity inversion may also be carried out after every row (row inversion) so as to reduce flicker effects.

In this device, significant amounts of power are consumed in the transfer of video information from the video signal source to the display pixels. In the case of the display device being used in portable, battery-powered, equipment such as a notebook computer of mobile phone, it is of course desirable to minimise electrical power consumed by the display device in operation. Power consumed can be reduced if the pixels are able to store the video information for an indefinite period as the addressing of the pixels with fresh video information could be halted if the pixels are merely to continue displaying the same information and no change to their display outputs is required.

Embodiments of active matrix display devices, particularly AMLCDs and active matrix LED display devices, in accordance with the present invention will now be described. The embodiments each utilise dynamic memory integrated into the pixel that uses the charge stored on the capacitance of one of the nodes within the pixel. A feature of these embodiments is that a read circuit is also integrated in the pixel, which allows the state of the pixel to be read onto a column electrode. A capacitance being used as the dynamic storage element within the pixel can then be refreshed via the column electrode. The read circuit integrated in the pixel preferably has a high input impedance so that it does not discharge the capacitance used for the memory, even during the read operation.

Figure 2:
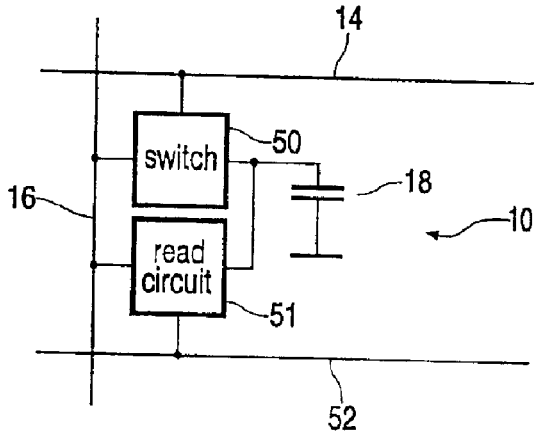
FIGS. 2, 3 and 4 illustrate schematically different pixel circuit configurations in respective embodiments of active matrix display devices according to the present invention.
Figure 3:
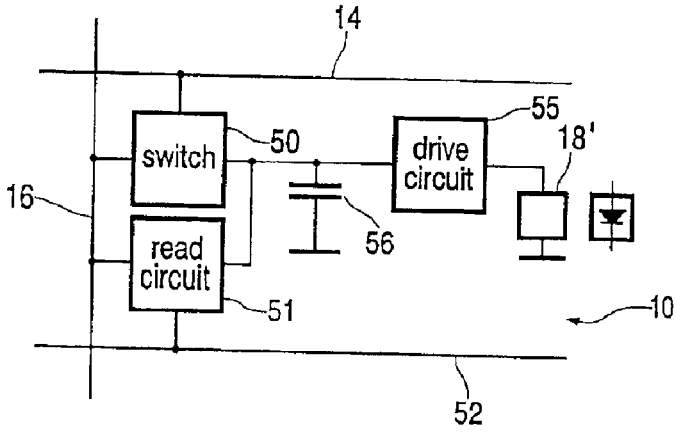
Figure 4:
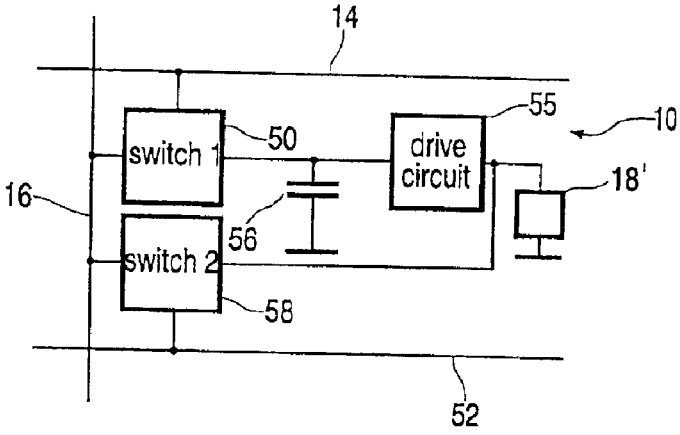

Three example pixel configurations are shown schematically in FIGS. 2, 3 and 4. The switch 50 shown in these figures corresponds to the switching device 12 in the arrangement of FIG. 1 and may similarly comprise a TFT. The read circuit included in the pixel 10 is referenced at 51. In each case, a supplementary row electrode, 52, is provided which extends parallel with the row electrodes 14 and is shared by all the pixels 10 in the respective row. In FIG. 2 the display element 18 is capacitive in nature (e.g. the LC in an AMLCD) and is itself used as the storage node of the dynamic memory. (Typically in an AMLCD an additional storage capacitance is usually added in parallel with the LC although this not shown here.) A voltage is transferred to the display element 18 from the column electrode 16 when the switch 50, controlled by row electrode 14, has a low impedance and this voltage is stored on the capacitance of the display element while the switch is in a high impedance state. The read circuit 51 is connected between the display element 18 and the column electrode 14 and is controlled by the supplementary row electrode 52. During a read operation the column electrode 16 is charged to a voltage determined by the state of the display element. Having performed the read operation it is then possible to refresh the display element 18 via the column electrode 16. The refresh operation may involve additional circuitry in the column driver circuit 35 to process the signal generated during the read operation.

In some active matrix display applications it is desirable to include additional circuitry to drive the display element, as shown in the embodiment of FIG. 3 with the display element referenced here at 18'. An example of this is a display device in which the display element comprises an LED, as indicated in the Figure, for example of polymer LED (PLED) or organic LED (OLED) device, that requires a drive circuit, here shown at 55, that can supply current. The data (video information) signal supplied via the switch 50 is stored as a voltage on a memory capacitor 56 connected between the switch 50 and read circuit 51 and the drive circuit 55 serving to provide the storage node capacitance and the drive circuit is operable to supply drive current for the display element 18' whose level corresponds to, or is determined by, the level of the stored signal. Apart from the addition of the drive circuit 55 for the display element, the basic read and refresh operation is the same in this embodiment as the embodiment of FIG. 2. In the arrangement of FIG. 3, both a display driving circuit 55 and a read circuit 51 are shown integrated within the pixel.

In some cases, it is possible to simplify this by combining the function of the display drive circuit 55 with the read circuit 5. An example of this is shown in the embodiment of FIG. 4. In this case a separate read circuit is not required, but instead a second switch, 58, is inserted between the output of the display element drive circuit 55 and the column electrode 16, the operation of this second switch 58 being controlled via the supplementary row electrode 52. A read operation is initiated when the second switch 58 is switched into a low impedance state, at which time the circuit 55 driving the display element 18' charges the column electrode 14 to a voltage dependent upon the state of the pixel.

Generally, when displaying a static image it is necessary to perform the read and refresh operation a row at a time. However if a region of the display array (i.e. multiple rows) has a plain background it is possible to refresh this region with a single read and refresh operation. This reduces power consumed by reducing the number of voltage transitions necessary on the column electrodes 14. In the case of an AMLCD driven in row inversion, the read and refresh operation for a region displaying a plain field would be performed with two read and refresh operations, one for each polarity.

Figure 5:
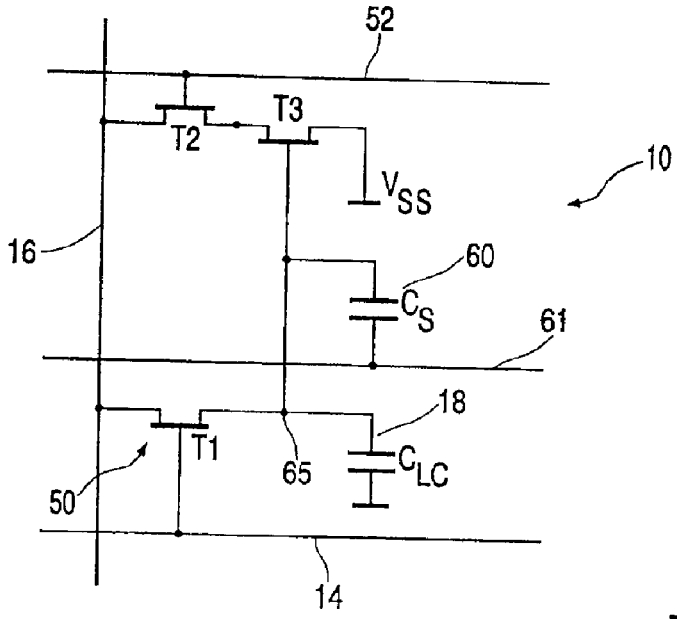
FIG. 5 shows in greater detail an example of a typical pixel circuit in one embodiment.

FIG. 5 shows in greater detail an example of an AMLCD pixel circuit employing the kind of configuration as illustrated in FIG. 2. Although n-channel TFTs are shown in this example it is equally possible to use p-channel TFTs (or a combination of n and p-channel) provided appropriate adjustments are made to the polarity of drive voltages. The TFTs T2 and T3 form the read circuit 51 while the TFT T1 constitutes the switch 50. In this example, the pixel includes a storage capacitor 60 connected between the display element 18 and a reference line 61, shared by other pixels in the same row and in the form of another supplementary row electrode. When displaying a static image in low power mode, TFTs T2 and T3 are used to sense the state of the pixel as one of two voltages on the column electrode 16. The pixel is then refreshed via the column electrode 16 in such a way that the LC is driven with alternating polarities each time the pixel is refreshed. The circuit, as described here, allows 1 bit of data to be stored/pixel. The AMLCD can also be operated in a normal mode where the display array is updated with video data sent continuously to the display device from an external source and sampled onto the pixels 10 using known row and column driver architectures. In this mode T3 is not used and T2 is held in its off-state by applying the appropriate voltage to the supplementary row electrode 52.

When displaying a static image in low power mode, a drive scheme is preferably used in which part of voltage across the LC is applied either via the common electrode or the storage capacitor 60 connected between the display element electrode and the line 61. These particular drive schemes facilitate the read and refresh operations.

Figure 6A:
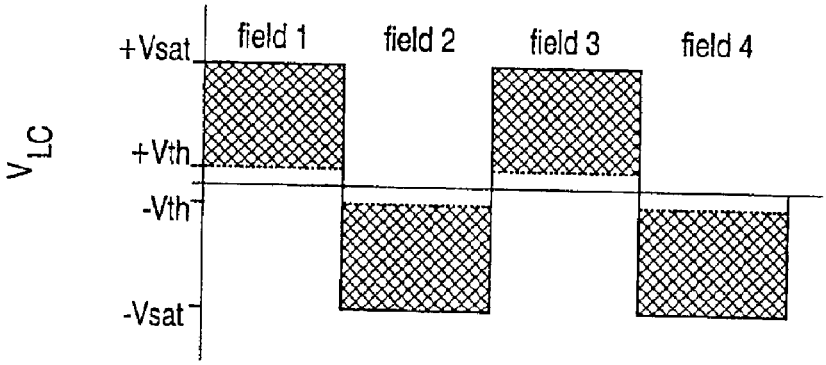
FIG. 6 illustrates various possible voltage levels appearing in an example AMLCD device using a particular drive scheme.
Figure 6B:
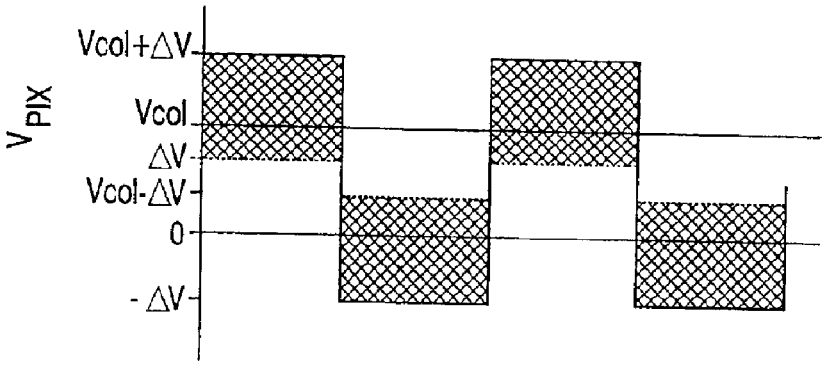

Consideration will now be given in more detail to the case where the additional voltage across the LC is coupled in via the storage capacitor line 61. FIGS. 6*a* and 6*b* illustrate respectively typical voltage levels appearing in operation of the device. Vsat and Vth denote respectively the LC display element saturation and threshold voltage levels. Vcol is the voltage on the column electrode 16 corresponding to the applied data signal. FIG. 6*a* shows how the voltage across the LC at the display element 18 varies over 4 successive fields, fields 1 to 4, for a given pixel in a particular row. When the magnitude of the voltage across the LC is Vth, the pixels are in a state of maximum brightness and when it is Vsat the pixels are black. The shaded regions indicate the range of voltages across the LC material for displaying different grey scales in the normal mode of operation. The polarity of the voltage across the LC is inverted every field to improve the lifetime of the LC. FIG. 6*b* shows the corresponding voltages on the display element electrode relative to the voltages on the column electrode, where the column electrode voltage range is between a minimum of 0 and a maximum of Vcol. The additional voltage coupled onto the display element electrode via the storage capacitor line 61 is ±ΔV, where:

$$\Delta V = Vcap.C_s/(C_s + C_{LC})$$

and Vcap is the voltage swing on the storage capacitor line 61, which changes by +Vcap in an odd field (for a particular row) and −Vcap in an even field (for a particular row), and $C_s$ and $C_{LC}$ respectively are the capacitances of the storage capacitor 60 and the LC display element 18.

When displaying a static image in low power mode the LC is driven with either ±Vth ("light" pixel) or ±Vsat ("black" pixel). From FIG. 6*b* it can be seen that the corresponding voltages on the display element electrode are: (i) for light pixels, +ΔV in an odd field and Vcol−ΔV in an even field, and (ii) for black pixels, $V_{COL}$+ΔV in an odd field and −ΔV in an even field.

Sensing the state of the pixel is achieved by first returning the voltage on the display element electrode to the initial value sampled into the pixel from the column electrode, prior to coupling in ±ΔV from the capacitor line, 61. This is done by switching the voltage on the capacitor line, which means the voltages on the display element electrode are returned to either 0 or Vcol. For light pixels the voltages on the display element electrode are returned to 0 in an odd field and Vcol in an even field. For black pixels the voltages on the display element electrode are returned to Vcol in an odd field and 0 in an even field.

Figure 7:
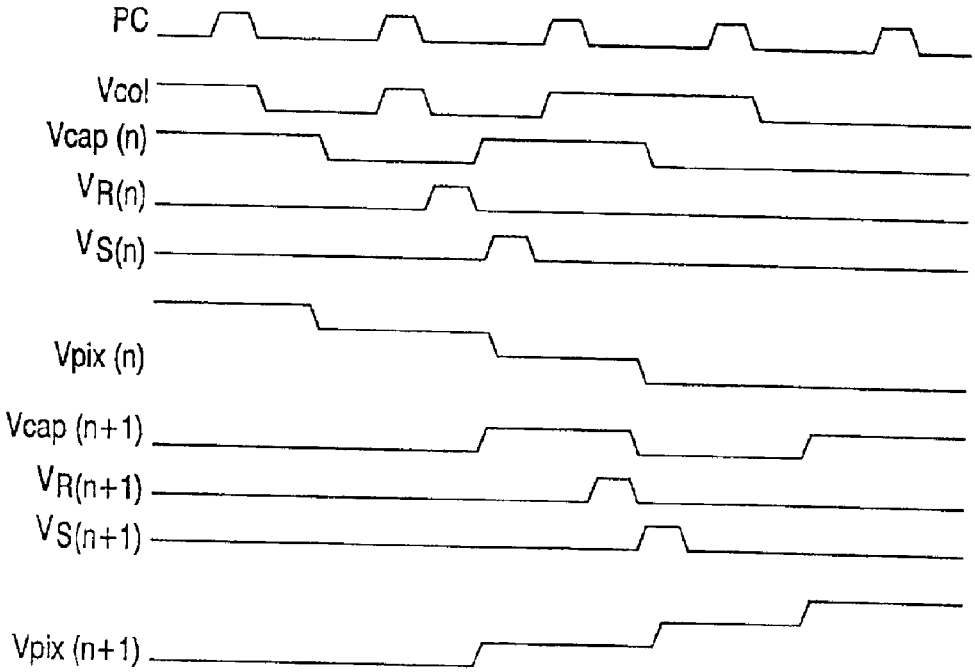
FIG. 7 shows example drive waveforms in operation in the example AMLCD.

The sense and refresh operations of pixels as shown in FIG. 5 is illustrated further in FIG. 7 which shows possible drive waveforms and their relative timings for two adjacent black pixels in successive rows n and n+1, connected to the same column electrode 16. In this example the polarity of the LC drive voltage is inverted every row (row inversion), though this is not a necessary feature. In FIG. 7, Vcap(n) and Vcap(n+1) are the waveforms applied to the capacitor drive lines 61 for pixel rows n and n+1 respectively, Vs(n) and Vs(n+1) are the selection signal waveforms applied to the row electrodes 14 associated with pixel rows n and n+1 respectively, $V_R$(n) and $V_R$(n+1) are the waveforms applied to the supplementary row electrodes 52 associated with pixel row n and n+1 respectively, and Vpix(n) and Vpix (n+1) are the voltage waveforms appearing at the node 65 in a pixel (FIG. 5) in pixel row n and pixel row n+1 respectively. The sense and refresh operation involves the following steps:

1) Switch capacitor line 61 to restore pixel voltage to either 0 or Vcol.
2) Pre-charge column electrode 16 to Vcol (in FIG. 7 pre-charge occurs when the Pre-charge control signal PC is high).
3) Turn on T2 to sense state of the pixel onto the column electrode. If Vpix=Vcol, T3 is turned on and the column electrode is discharged to VSS (0V) and if Vpix=0,T3 is off and the column electrode voltage is held at Vcol. This means the column electrode voltage is the inverted relative to Vpix.
4) Switch capacitor line 61 back to previous level.
5) Write inverted data back into pixel by turning on T1.

6) Switch capacitor line 61 to couple in additional pixel voltage appropriate to drive the LC.

It should be noted that $V_{ss}$ may take values other than 0V if required.

Figure 8:
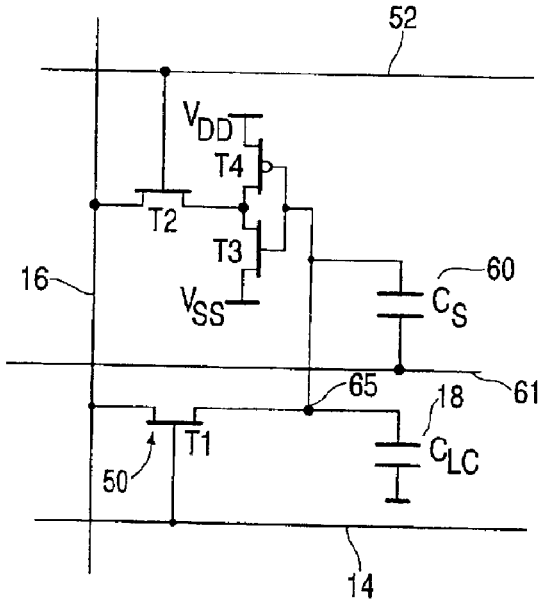
FIG. 8 shows in detail another example of a typical pixel circuit in an embodiment of AMLCD according to the invention.

A second example of a pixel circuit with the same configuration as in FIG. 2 and applied to an AMLCD is shown in FIG. 8. In this case an inverter constituted by the TFTs (p and n type) T4 and T3 is used to sense the state of the pixel onto the column electrode 16 during a read operation, which avoids the requirement to pre-charge the column electrode prior to the read operation. This has the advantage that it can reduce the number of transitions on the column electrode, depending upon the image and whether field or line inversion is used.

In the two examples described above, with reference to FIGS. 5 and 8, the static image stored in low power mode contains no grey scales (i.e. the stored image is 1 bit/pixel). It is possible to introduce grey scales by using the same read circuits to detect multiple levels. This can be achieved by dividing the read time into several stages and stepping the voltage on the capacitor line 61. During one of the steps the voltage on the pixel's display element 18 will exceed a threshold above which the read circuit is able to invert the voltage on the column electrode. The point at which the inversion occurs depends upon the initial voltage on the display element, so this constitutes a read operation. In this case, additional circuitry is required in the column driver circuit 35 to generate the appropriate voltage to refresh the pixel. An alternative method of achieving grey scale is to sub-divide each pixel into multiple (area-ratioed) sub-pixels, where each sub-pixel is still driven either black or to maximum brightness.

Although the examples described above are applicable for a situation in which a capacitor line drive scheme is used, the same principles apply to common electrode drive schemes.

Figure 9:
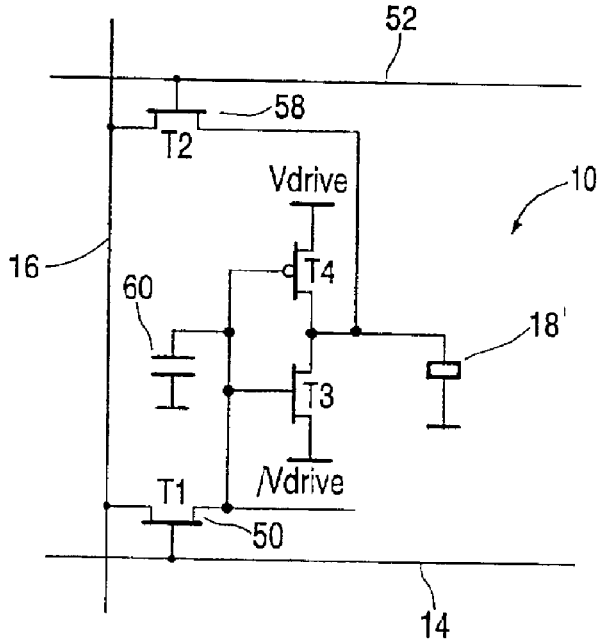
FIG. 9 shows in detail a further example of a typical pixel circuit in another embodiment of AMLCD according to the present invention.

A third example of a pixel circuit, in this case with a configuration the same as in FIG. 4 is shown in FIG. 9. In this circuit, the TFT T2 constitutes the second switch 58 and the TFTs T3 and T4 constitute the drive circuit 55. The display element may be an LC display element or a current-driven display element, for example an LED.

Figure 10:
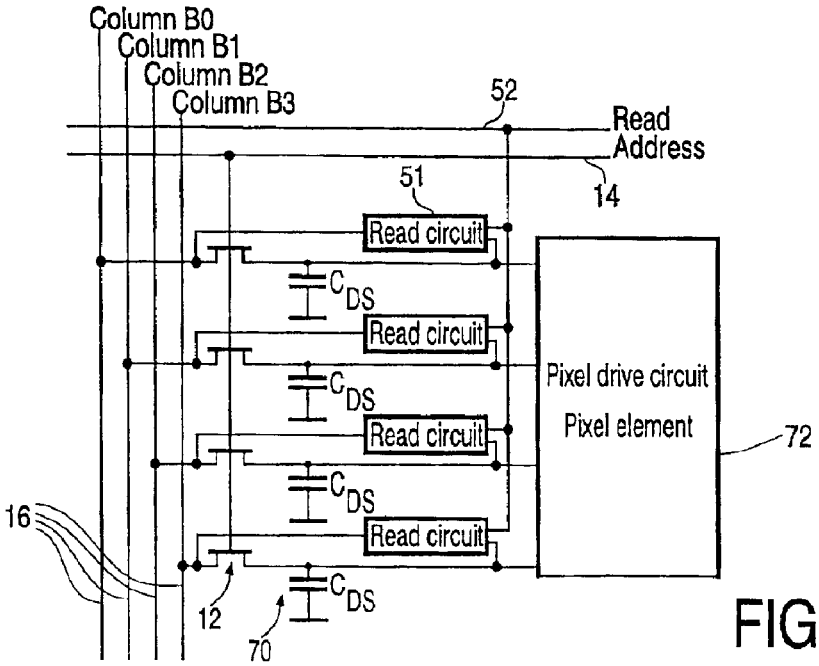
FIG. 10 shows a further example of a pixel circuit having a plurality of data storage capacitors.

FIG. 10 shows a circuit having a plurality of capacitors each storing a bit of data, the plurality of bits specifying a grey scale level.

A plurality of data storage capacitors 70 are connected to a corresponding plurality of columns 16 through TFTs 12 connected to common row address line 14. Supplementary row electrode 52 controls a read circuit 51 for each of the data storage capacitors 70. Pixel drive circuitry 72 is represented schematically by box 72 with inputs from each of the data storage capacitors 70.

In use, data can be supplied to the data storage capacitors 70 in parallel through columns 16. By applying a signal on supplementary row electrode 52 data can be read back up the columns 16 so that the data can be subsequently be rewritten to refresh the data.

Figure 11:
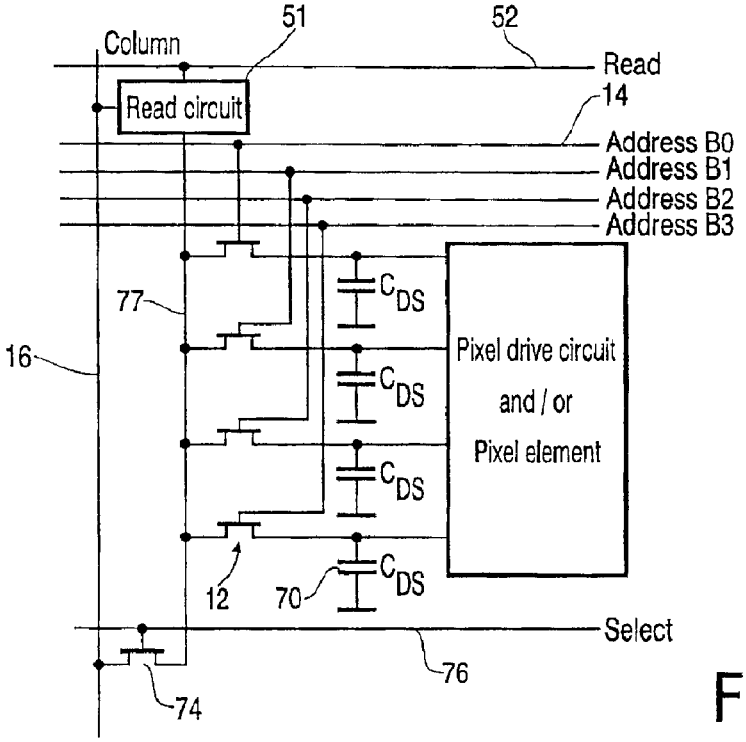
FIG. 11 shows a further example of a pixel circuit having a plurality of data storage capacitors.

An alternative multi-bit arrangement is shown in FIG. 11, which has a plurality of address lines 14 for each row and a single column line 16 for each column. A select line 76 is provided on each row to control select transistor 74 which connects column line 16 to TFTs 12, via a data line 77.

In use, one of the plurality of address lines 14 is enabled to select a corresponding data storage capacitor 70. Read line 52 can be enabled to cause read circuit 51 to read the data on selected data storage capacitor 70 onto column line 16. Alternatively, select line 76 can enable select TFT 74 so that data on column line 16 is written to the selected data storage capacitor 70.

Figure 12:
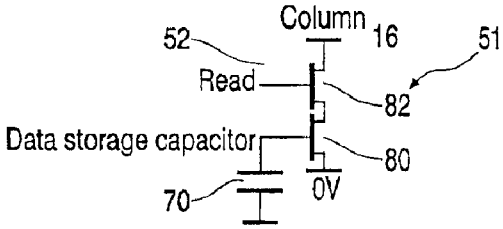
FIG. 12 shows a read circuit.

An example read circuit 51 connected to a data storage capacitor 70 is illustrated in FIG. 12. The data storage capacitor 70 controls first TFT 80 connected in series through read TFT 82 to column 16. Read TFT 82 is controlled by read line 52. When read line 52 switches read TFT 82 on, the data stored on the data storage capacitor 70 is read onto column 16.

Figure 13:
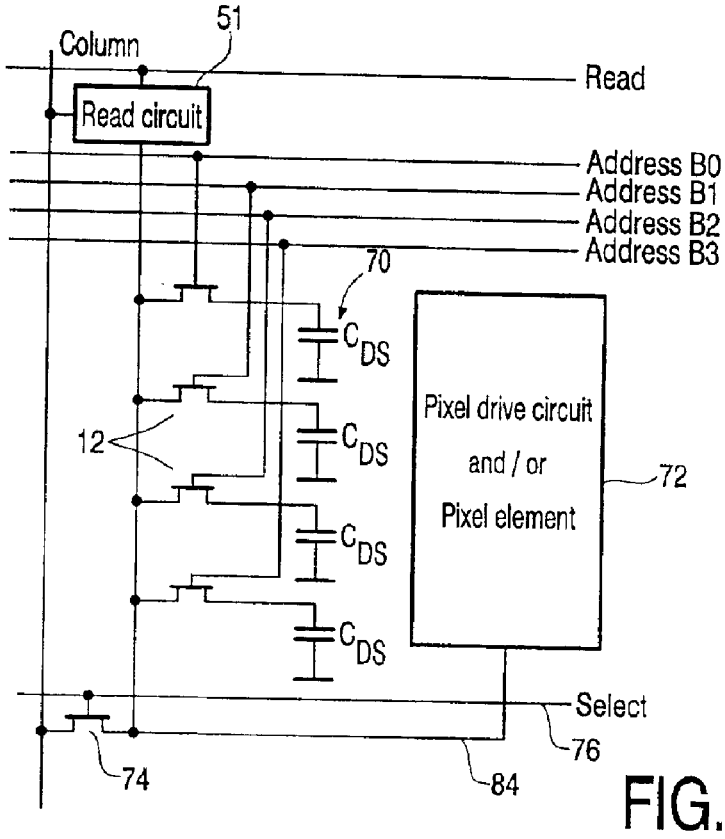
FIG. 13 shows another example of a pixel circuit having a plurality of data storage capacitors.

As well as the parallel connection of data storage capacitors 70 to drive circuitry 72 as illustrated above, the data on the plurality of data storage capacitors 70 can be connected to the drive circuitry 72 by a single data line 84 as illustrated in FIG. 13. In this circuit, data is transferred to drive circuitry 72 sequentially, by addressing the individual TFTs 12 one after the other to connect the corresponding data storage capacitors 70 to drive circuitry 72.

Figure 14:
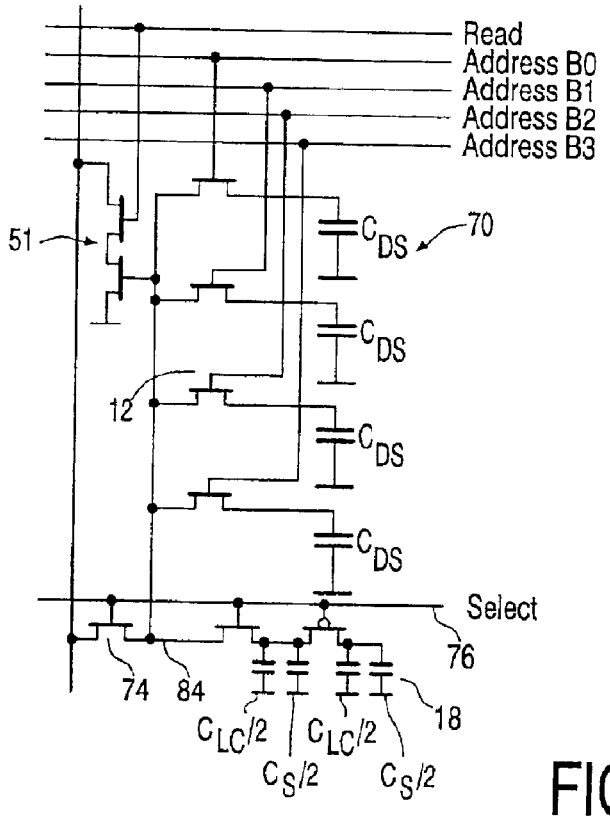
FIG. 14 shows a yet further example of a pixel circuit having a plurality of data storage capacitors.

A further embodiment is illustrated in FIG. 14, which performs serial charge redistribution digital to analogue conversion using the pixel capacitance itself 18. Features of this circuit are described in more detail in U.S. Pat. No. 5,448,258 and U.S. Pat. No. 5,923,311, which are incorporated herein by reference. For present purposes note that as in FIG. 13 capacitors 70 are connected to data line 84 through respective switches 12, and the data line 84 in turn drives pixel capacitances 18.

It is possible to simultaneously operate some pixels in the array in the static mode using data stored within the pixels and others using data supplied by an external signal source. This can be achieved without modifying the pixel circuit simply by driving the display with the appropriate signals. This approach can minimise power consumption.

For example, part of the display can show a moving image whilst the rest of the display shows a static background. The external video source only needs to supply the display with data for the region of the image showing the moving image thereby saving power.

The invention is applicable to various kinds of active matrix display devices and pixel circuits similar to those described above could be used in display devices other than AMLCD and AMLEDs where it is desirable to store a static image, for example in electrochromic, electrophoretic and electroluminescent type display devices. An example of an active matrix LED display device is described in EP-A-1116205 whose whole contents are incorporated herein as background material.

From the present disclosure, many other modifications and variations will be apparent to persons skilled in the art. Such modifications and variations may involve other features which are already known in the art and which may be used instead of or in addition to features already disclosed herein.

What is claimed is:

1. An active matrix display device comprising:

a plurality of pixels arranged as rows and columns, and column electrodes extending along corresponding columns of pixels, wherein:

each pixel of the plurality of pixels includes:

an image data storage capacitance, and a read circuit for reading a state of the image data storage capacitance, and for driving a corresponding column electrode of the column electrodes in accordance with the state of the image data storage capacitance, and the read circuit has an input impedance that is sufficiently high that charge stored on the image data storage capacitance is not significantly discharged during reading.

2. An active matrix display device according to claim 1, further including row electrodes and read lines extending along corresponding rows of pixels, wherein the pixels contain a switch connecting the corresponding column electrode to the data storage capacitance when the switch is selected by the corresponding row electrode and the read circuit is controlled by the corresponding read line to read the capacitance onto the corresponding column electrode.

3. An active matrix display device according to claim 2 wherein the pixels contain a drive circuit driving a pixel display component, the drive circuit having its input connected to the image data storage capacitance.

4. An active matrix display device according to claim 3 wherein the read circuit includes the drive circuit and a switch connecting the output of the drive circuit to the corresponding column electrode under the control of the corresponding read line.

5. An active matrix display device according to claim 4, further including a corresponding read circuit for each of the image data storage capacitances.

6. An active matrix display device according to claim 3, wherein each pixel includes a plurality of image data storage capacitances, each of the plurality of image storage capacitances corresponding to a bit of a multi-bit grey scale value of the stored image data.

7. An active matrix display device according to claim 1, wherein each pixel includes a plurality of image data storage capacitances, each of the plurality of image storage capacitances corresponding to a bit of a multi-bit grey scale value of the stored image data.

8. An active matrix display device according to claim 7, further including a corresponding read circuit for each of the image data storage capacitances.

9. An active matrix display device comprising:

a plurality of pixels arranged as rows and columns; and column electrodes extending along corresponding columns of pixels;

wherein the pixels include:

a plurality of image data storage capacitances, and a dedicated read circuit connected to each image data storage capacitor for reading a state of the image data storage capacitance and for driving the corresponding column electrode in accordance with the state of the image data storage capacitance.

10. An active matrix display device according to claim 9, further including a plurality of row electrodes along each row, each row electrode selecting a respective switch connecting a respective image data storage capacitor to a data line, a select line controlling a switch connecting the data line to the corresponding column electrode, and wherein the read circuit reads the data on the data line onto the corresponding column electrode under the control of the corresponding read line.

11. A method of operating an active matrix display device having pixel elements including storage nodes, comprising:

storing image data on the storage nodes, operating the active matrix device in a static mode including:

displaying the stored image data, and periodically applying read signals to read circuitry within the pixel elements to cause the read circuitry to read the stored image data to column electrodes, and refreshing the image data stored on the storage nodes, wherein refreshing the image data includes alternating the polarity of the image data stored on the storage nodes.

12. A method according to claim 11 further comprising operating the active matrix display device in a normal mode including regularly addressing the pixel elements with fresh video information and displaying the video information.

13. A method according to claim 11 further including precharging the column electrodes, and wherein the read circuitry reads the stored image data by selectively discharging the column electrodes based on the stored image data.

14. A method of operating an active matrix display device having a plurality of pixels that each include at least one read element, and one or more storage elements that facilitate storage of a range of grey scale values corresponding to an image data value of the pixel, the method comprising:

enabling the at least one read element of a pixel, to thereby provide a grey scale value of the pixel to a set of one or more column electrodes associated with the pixel, and refreshing the image data value to the one or more storage elements of the pixel, wherein enabling the one or more read elements includes applying multiple read signals to read each of the multiple storage elements, thereby facilitating reading of a grey scale value of the stored image data.

15. A method according to claim 14, further including offsetting the stored image data.

16. An active matrix display device comprising:

a plurality of pixels arranged as rows and columns; and column electrodes extending along corresponding columns of pixels;

wherein each pixel of the plurality of pixels includes a plurality of image data storage capacitances that are configured to store an image data value corresponding to a multi-bit grey scale value of corresponding image data, each of the plurality of image storage capacitances corresponding to a bit of the multi-bit grey scale value of the stored image data, and a corresponding read circuit for each of the image data storage capacitances for reading the grey scale value of the image data and for driving one or more corresponding column electrodes in accordance with the image data value.

* * * * *